US007993147B2

(12) United States Patent
Cole et al.

(10) Patent No.: US 7,993,147 B2
(45) Date of Patent: Aug. 9, 2011

(54) CARD EDGE MODULE CONNECTOR ASSEMBLY

(75) Inventors: Jordan Marshall Cole, San Jose, CA (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 194 days.

(21) Appl. No.: 12/371,702

(22) Filed: Feb. 16, 2009

(65) Prior Publication Data

US 2010/0210123 A1 Aug. 19, 2010

(51) Int. Cl.
*H01R 12/00* (2006.01)

(52) U.S. Cl. ..... 439/79; 439/607.39

(58) Field of Classification Search ..... 439/79, 439/637, 607.39, 607.07
See application file for complete search history.

(56) References Cited

U.S. PATENT DOCUMENTS 4,405,189 A * 9/1983 Douty et al. ..... 439/62
5,511,985 A * 4/1996 Noschese et al. ..... 439/157
6,811,440 B1 * 11/2004 Rothermel et al. ..... 439/79
7,011,556 B2 3/2006 Miyazawa et al.
7,114,963 B2 * 10/2006 Shuey et al. ..... 439/79
7,175,446 B2 * 2/2007 Bright et al. ..... 439/79
7,585,186 B2 * 9/2009 McAlonis et al. ..... 439/607.05
7,588,468 B2 * 9/2009 Biddle et al. ..... 439/637

OTHER PUBLICATIONS

"High Speed Backplane Connectors"; Tyco Electronics, Catalog 1773095, Revised Dec. 2008, 44 pgs.
Product Specification "Z-Pack TinMan Connector System"; 108-2303, Apr. 25, 2008 Rev. A, 8 pgs.
1934807-1 Product Details, Z-Pack TinMan Connectors, Cable Assemblies and Accessories, 2 pgs, 2009.

* cited by examiner

*Primary Examiner* — Xuong M Chung Trans

(57) ABSTRACT

A connector assembly includes a housing and contacts. The connector includes a mounting face and a mating face disposed transverse to one another. The mounting face is used to mount the connector to a substrate. The mating face has an elongated slot that is configured to receive a mating edge of a card edge module. The contacts extend between opposite contact tips at each of the mounting face and the mating face. The contact tips at the mounting face are configured to electrically couple the connector with the substrate. The contact tips at the mating face are configured to electrically couple the connector with the card edge module. The card edge module is oriented transverse to the substrate when the card edge module mates with the connector.

23 Claims, 4 Drawing Sheets

CARD EDGE MODULE CONNECTOR ASSEMBLY

BACKGROUND OF THE INVENTION

The subject matter herein relates generally to electrical connectors, and more particularly, to connector assemblies that mate with card edge modules.

With the ongoing trend toward smaller, faster, and higher performance electrical components such as processors used in computers, routers, switches, and the like, it has become increasingly important for the electrical interfaces along the electrical paths to also operate at higher frequencies and at higher densities with increased throughput. For example, performance demands for video, voice and data drive input and output speeds of connectors within Such systems to increasingly faster levels. In one known approach for mating a card edge module with a circuit board, a card edge connector is mounted to a surface of the circuit board and the card edge module is loaded into the card edge connector. The card edge module is received into the card edge connector such that the card edge module extends above the circuit board in a direction approximately perpendicular to the circuit board.

Some known card edge connectors suffer from several drawbacks. For example, some known card edge connectors have problems operating at the higher performance levels of current systems. For example, known card edge connectors have limits to high speed electrical performance due to increased crosstalk, noise persistence, electrical impedance, and electrical skew of the card edge connectors when the card edge connectors are used to communicate relatively higher frequencies or higher signal densities. Additionally, the mating positions of some known card edge connectors block or significantly impede airflow above the circuit board. These card edge connectors receive card edge modules in such a way that the card edge modules extend above the circuit board. Given the planar shape of the card edge modules, the card edge modules may significantly block or impede airflow above the circuit board. As electrical systems that include the card edge connectors operate at higher frequencies and at higher densities with increased throughput, the heat dissipated by the system and the card edge connectors may increase. The need to adequately cool the systems and card edge connectors relies on the ability of air to flow over the circuit boards in the systems and to which the card edge connectors are mounted. As more card edge modules are located above the circuit boards, less air can flow over the circuit boards to cool the systems and the card edge connectors.

Thus, a need exists for a connector that permits the communication of data at higher frequencies and at higher densities with increased throughput using a card edge module. Moreover, a need exists for a connector that receives a card edge module without significantly blocking or impeding the flow of air through the system that includes the connector.

BRIEF DESCRIPTION OF THE INVENTION

In one embodiment, a connector assembly is provided. The connector assembly includes a connector and contacts. The connector includes a housing that has a mounting face and a mating face disposed transverse to one another. The mounting face is used to mount the connector to a substrate. The mating face has an elongated slot that is configured to receive a mating edge of a card edge module. The contacts extend between opposite contact tips at each of the mounting face and the mating face. The contact tips at the mounting face are configured to electrically couple the connector with the substrate. The contact tips at the mating face are configured to electrically couple the connector with the card edge module. The card edge module is oriented transverse to the substrate when the card edge module mates with the connector. Optionally, the mounting face and the mating face are disposed approximately perpendicular to one another.

In another embodiment, a connector assembly for mating a card edge module with a substrate is provided. The connector assembly includes a connector, first and second contact module assemblies, and contacts. The connector includes transverse mounting and mating faces. The mounting face is used to mount the connector to the substrate. The mating face is used to receive the card edge module to mechanically couple the connector and card edge module. The first and second contact module assemblies are disposed in the connector and oriented transverse to the substrate. The first and second contact module assemblies each include a mounting edge disposed proximate the mounting face and a mating face disposed proximate the mating face. The contacts are disposed in the contact module assemblies and extend from the mounting edges to the mating edges. The contacts are engageable with the substrate and the card edge module to electrically couple the substrate and the card edge module. Alternatively, the mating face of the connector includes a card edge slot that is shaped to receive the card edge module. The card edge slot may be oriented approximately perpendicular to the substrate.

DETAILED DESCRIPTION OF THE INVENTION

Figure 1:
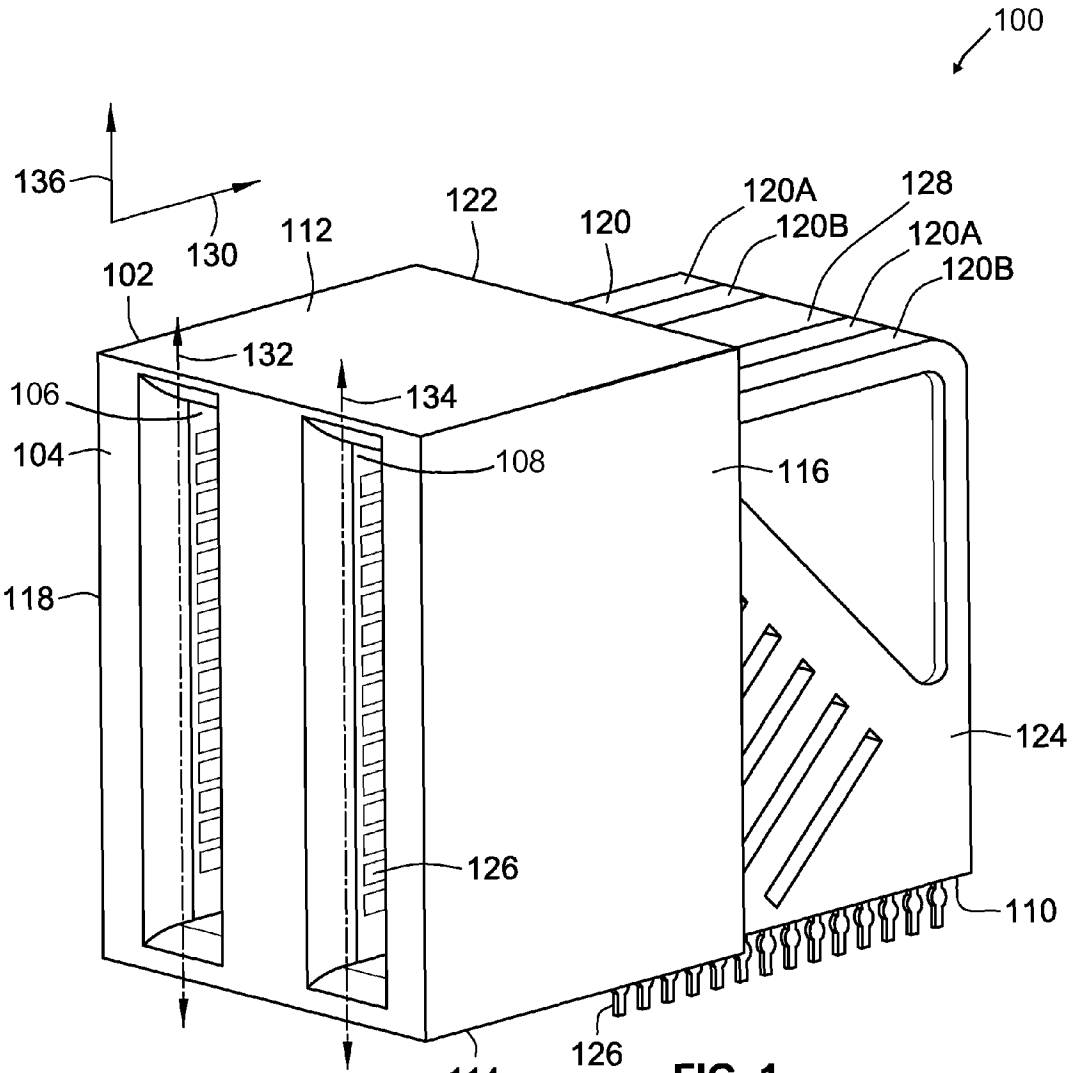
FIG. 1 is a perspective view of a connector assembly implemented in accordance with one embodiment of the presently described invention.

FIG. 1 is a perspective view or a connector assembly 100 implemented in accordance with one embodiment of the presently described invention. While the connector assembly 100 is described with particular reference to the embodiment shown in FIG. 1, it is to be understood that the benefits herein described are also applicable to other connectors in alternative embodiments. The following description is therefore provided for purposes of illustration, rather than limitation, and is but one potential application of the subject matter herein. As shown in FIG. 1, the connector assembly 100 includes a dielectric shroud 102 having a mating face 104. The shroud 102 includes an upper surface 112 and a lower surface 114 between opposite sides 116, 118. A plurality of card edge slots 106, 108 are disposed in the shroud 102 at the mating face 104. Each of the card edge slots 106, 108 receives a mating edge 308 (shown in FIG. 3) of a card edge module 304 (shown in FIG. 3). Each of the card edge slots 106, 108 is elongated along a respective longitudinal axis 132, 134 within the plane defined by the mating face 104. The longitudinal axes 132, 134 extend parallel to a transverse direction 136 in the illustrated embodiment. The card edge slots 106, 108 receive the card edge modules 304 to electrically and mechanically couple the card edge modules 304 and the connector assembly 100. The connector assembly 100 also includes a mounting face 110 disposed transverse to the mating face 104. For example, a plane defined by the mating face 104 may be approximately perpendicular to a plane defined by the mounting face 110. The mounting face 110 is mounted to a substrate 300 (shown in FIG. 3) to electrically and mechanically join the connector assembly 100 and the substrate 300.

A plurality of contact module assemblies 120 are received in the shroud 102 from a rearward end 122. The contact module assemblies 120 have approximately planar dielectric bodies 124 located in the shroud 102 such that the bodies 124 are transverse to the plane defined by the mating face 104. For example, the contact module assemblies 120 may be arranged as approximately parallel bodies 124 that are substantially perpendicular to the mating face 104. Each contact module assembly 120 includes a plurality of contacts 126. The contacts 126 extend through the contact module assemblies 120 from proximate the mating face 104 to proximate the mounting face 110. The contacts 126 electrically couple the card edge module 304 (shown in FIG. 3) with the substrate 300 (shown in FIG. 3) when card edge module 304 is loaded into one of the slots 106, 108 and the connector assembly 100 is mounted to the substrate 300. In one embodiment, the shroud 102 holds two or more different types of contact module assemblies 120, such as, but not limited to, contact module assemblies 120A, 120B. Alternatively, the shroud 102 may hold only a single type of contact module assembly 120, such as, but not limited to, any of the contact module assemblies 120A, 120B. As described below, each of the contact module assemblies 120A, 120B may hold a different subset 208, 210 (shown in FIG. 2) of the contacts 126. A support element 128 extends from the shroud 102 in a rearward direction 130. The rearward direction 130 is transverse to the mating face 104. For example, the rearward direction 130 may be approximately perpendicular to the mating face 104 and to the transverse direction 136. The support element 128 provides spacing between the contact module assemblies 120A, 120B in order to separate the card edge slots 106, 108 by a predetermined distance. Additionally, the support element 128 may provide structural support to the shroud 102.

Figure 2:
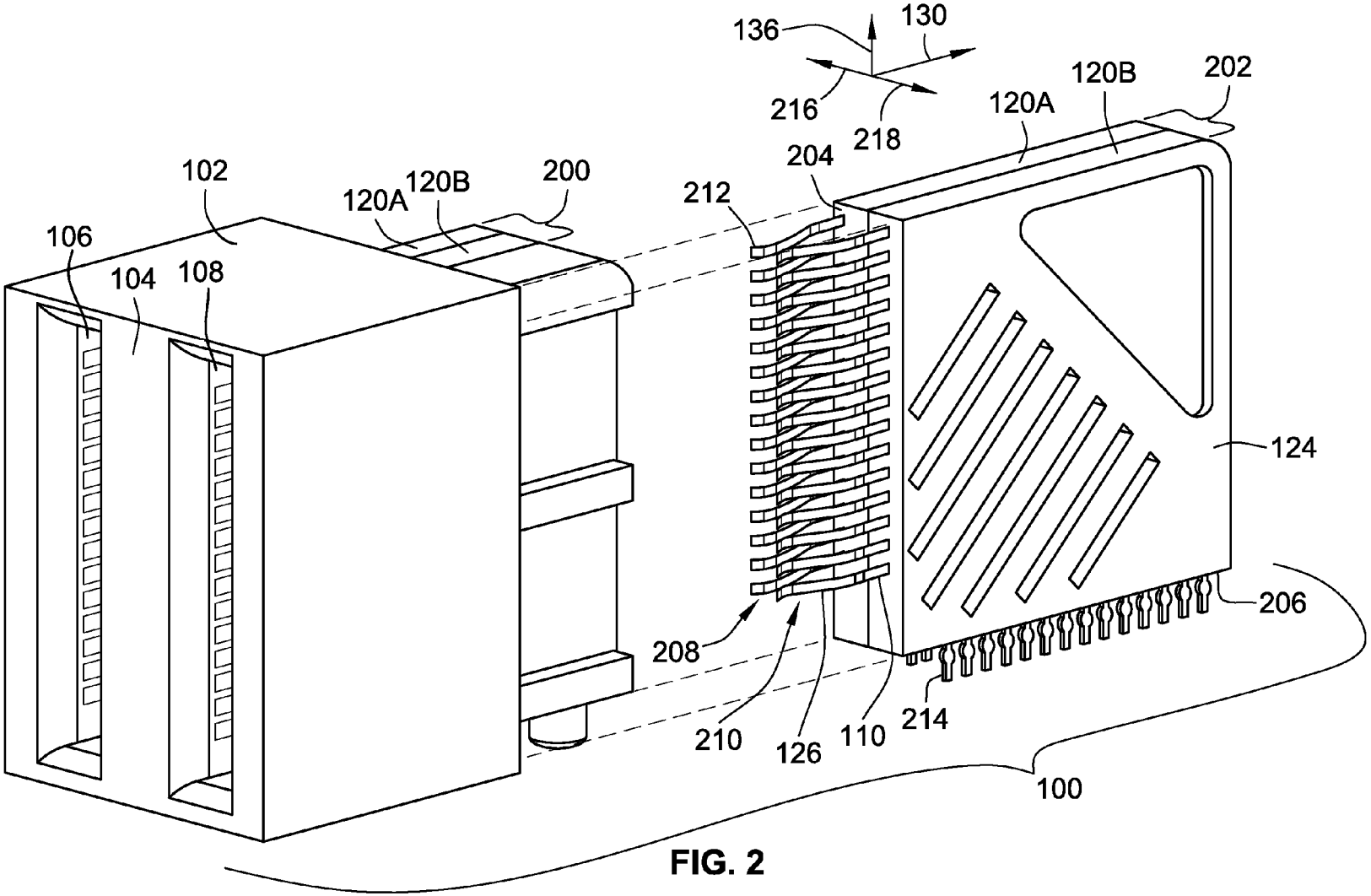
FIG. 2 is a partial exploded view of the connector assembly shown in FIG. 1 in accordance with one embodiment of the presently described invention.

FIG. 2 is a partial exploded view of the connector assembly 100 in accordance with one embodiment of the presently described invention. The contact module assemblies 120A, 120B are arranged in sets 200, 202 of two contact module assemblies 120A, 120B per set. Alternatively, the contact module assemblies 120A. 120B may be combined as a single body or a different number of contact module assemblies 120A, 120B may be included in each set 200, 202. The contact module assemblies 120A, 120B each include a mating edge 204 and a mounting edge 206. The mating and mounting edges 204, 206 are disposed transverse to one another. For example, the mating and mounting edges 204, 206 may be approximately perpendicular to one another. The contact modules assemblies 120A, 120B are loaded into the shroud 102 of the connector assembly 100 such that the mating edges 204 of the contact module assemblies 120A, 120B are located proximate to the mating face 104 of the shroud 102. For example, the mating edges 204 may be disposed within the shroud 102 behind the mating face 104. The mounting edges 206 of the contact module assemblies 120A, 120B are located at or proximate to the mounting face 110 of the connector assembly 100. For example, the mounting edges 206 may be at least partially coextensive with the plane defined by the mounting face 110.

Each contact module assembly 120A, 120B includes one of the subsets 208, 210 or the contacts 126. The contact module assemblies 120A, 120B may separate the contacts 126 that mate with opposite sides 314, 316 (shown in FIG. 3) of the card edge module 304 (shown in FIG. 3). For example, the contact module assembly 120A may include the subset 208 of contacts 126 that mate with contact pads 312 (shown in FIG. 3) on one side 314 (shown in FIG. 3) of the card edge module 304 (shown in FIG. 3) while the contact module assembly 120B includes the subset 210 of contacts 126 that mate with contact pads 312 on an opposite side 316 (shown in FIG. 3) of the card edge module 304. Separating the subsets 208, 210 of contacts 126 into different, physically separate contact module assemblies 120A, 120B may permit the electrical impedance characteristics of the contact module assemblies 120A, 120B and/or of the connector assembly 100 to be controlled and matched to the electrical impedance characteristic of the system that includes the connector assembly 100. The path of the contacts 126 as the contacts 126 extend through the individual contact module assemblies 120A, 120B may be designed to reduce the electrical skew of the conductive pathways established by the contacts 126 through each contact module assembly 120A, 120B. Controlling the electrical impedance and/or reducing the electrical skew of the contact module assemblies 120A, 120B may reduce the crosstalk or noise persistence of the connector assembly 100.

The contacts 126 extend from mating contact tips 212 to mounting contact tips 214. The mating contact tips 212 protrude from the mating edges 204 of the contact module assemblies 120A, 120B. The mating contact tips 212 in each subset 208, 210 are linearly aligned with one another in a direction parallel to the transverse direction 136. The mating contact tips 212 have arcuate shapes in the illustrated embodiment. The mating contact tips 212 in the contact module assemblies 120A, 120B of each set 200, 202 are arched in opposing directions. For example, the mating contact tips 212 in the contact module assemblies 120A of the sets 200, 202 may have shapes that are convex in a first lateral direction 216 and the mating contact tips 212 in the contact module assemblies 120B of the sets 200, 202 may have shapes that are convex in a second lateral direction 218. The first and second lateral directions 216, 218 extend in opposite directions. The first and second lateral directions 216, 218 are transverse to the rearward direction 130 and the transverse direction 136. For example, the first and second lateral directions 216, 218 may be approximately perpendicular to the rearward direction 130 and the transverse direction 136. The mating contact tips 212 of each set 200, 202 are disposed in a corresponding card edge slot 106, 108 of the shroud 102. For example, the mating contact tips 212 of the set 200 may be oriented in two lines along the transverse direction 136 within the card edge slot 106 and the mating contact tips 212 of the set 202 may be oriented in two lines along the transverse direction 136 within the card edge slot 108.

The mounting contact tips 214 protrude from the mounting edges 206 of the contact module assemblies 120A, 120B. The mounting contact tips 214 may be contact pins shaped to be loaded into plated cavities or holes (not shown) in the substrate 300 (shown in FIG. 3), for example. The mounting contact tips 214 of each contact module assembly 120A, 120B are linearly aligned with one another along the rearward direction 130 in the illustrated embodiment. Alternatively, one or more of the mounting contact tips 214 in one or more contact module assemblies 120A, 120B may be staggered with respect to one another along the rearward direction 130.

The contacts 126 extend through the contact module assemblies 120A, 120B to electrically interconnect the mating contact tips 212 with the mounting contact tips 214. The contacts 126 may be provided on a lead frame (not shown) that is overmolded with the dielectric body 124. The contacts 126 may be arranged within the contact module assemblies 120A, 120B and/or within the sets 200, 202 to communicate differential pair signals between the substrate 300 (shown in FIG. 3) and the card edge modules 304 (shown in FIG. 3). For example, the contacts 126 may extend through the contact module assemblies 120A, 120B as described in U.S. patent application Ser. No. 11/869,417, entitled "Performance Enhancing Contact Module Assemblies" (the '417 Application). The disclosure of the '417 Application is incorporated by reference herein in its entirety. The paths of the contacts 126 through the contact module assemblies 120A, 120B may be established or designed to match the electrical impedance characteristics of the contact module assemblies 120A, 120B and/or the connector assembly 100 with the system (not shown) in which the connector assembly 100 is used. The paths of the contacts 126 may be established in order to provide high speed communication of signals through the connector assembly 100. For example, the contacts 126 may be arranged in the contact module assemblies 120A, 120B in order to communicate high speed differential signals.

Figure 3:
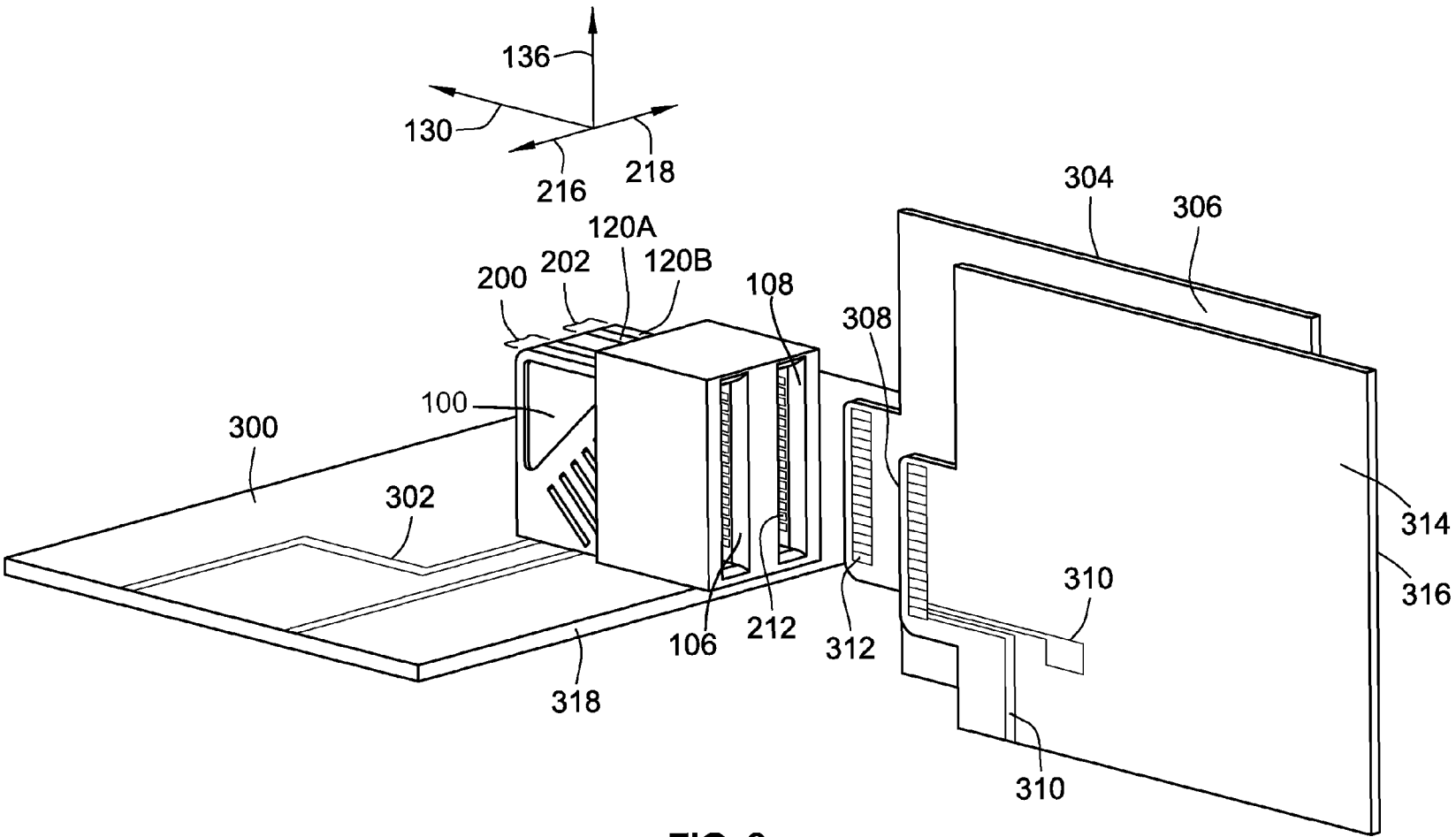
FIG. 3 is a perspective view of the connector assembly shown in FIG. 1 mounted to a substrate according to one embodiment of the presently described invention.

FIG. 3 is a perspective view of the connector assembly 100 mounted to the substrate 300 according to one embodiment of the presently described invention. The substrate 300 may include cavities or holes (not shown) that receive the mounting contact tips 214 (shown in FIG. 2) of the connector assembly 100. The cavities or holes may be plated to electrically couple the connector assembly 100 with the substrate 300. The substrate 300 may include conductive pathways 302 that communicate signals with the connector assembly 100 using the contacts 126 (shown in FIG. 1). For example, the substrate 300 may be a printed circuit board that includes conductive traces as the conductive pathways 302.

Each of the card edge modules 304 includes a planar substrate 306 that has a mating edge 308 and a plurality of conductive pathways 310. The conductive pathways 310 may be embodied in conductive traces, for example. The conductive pathways 310 are electrically coupled with contact pads 312 disposed at or proximate to the mating edge 308. The contact pads 312 may be provided on one or both sides 314, 316 of the card edge modules 304. The substrate 306 also may include electrical components (not shown) mounted thereon. By way of example only, processors, memory, and other types of resources may be provided on the card edge modules 304. The card edge modules 304 shown in FIG. 3 are provided merely as examples and are not intended to be limiting on every embodiment disclosed herein.

The mating edges 308 are loaded into the card edge slots 106, 108 of the connector assembly 100 to mechanically and electrically couple the connector assembly 100 and the card edge modules 304. As described above, the mating contact tips 212 in each card edge slot 106, 108 are linearly aligned with one another in two lines along the inside of the card edge slot 106, 108. The mating edge 308 of a card edge module 304 is loaded between opposing pairs of the mating contact tips 212 in the corresponding card edge slot 106, 108. For example, the mating edge 308 may be loaded between the mating contact tips 212 of the contact module assembly 120A and the mating contact tips 212 of the contact module assembly 120B. The mating contact tips 212 may be deflected in the lateral directions 216, 218. The mating contact tips 212 of the contact module assembly 120A may be deflected in the first lateral direction 216 and the mating contact tips 212 of the contact module assembly 120B may be deflected in the second lateral direction 218. The contact pads 312 of one card edge module 304 engage the mating contact tips 212 of one set 200, 202 of the contact module assemblies 120A, 120B to electrically couple the card edge module 304 with the contact module assemblies 120A, 120B of the corresponding set 200, 202. Once the mating edge 308 is loaded into the card edge slot 106, 108, the mating contact tips 212 of the contact module assembly 120A engage the contact pads 312 on one side 314 of the mating edge 308 while the mating contact tips 212 of the contact module assembly 120B engage the contact pads 312 on the other side 316 of the mating edge 308. The card edge module 304 is then electrically coupled with the substrate 300 through the connector assembly 100.

As shown in FIG. 3, the connector assembly 100 may be mounted to the substrate 300 proximate to or at an edge 318 of the substrate 300. Mounting the connector assembly 100 at the edge 318 permits the card edge modules 304 to be loaded into the connector assembly 100 while reducing the amount of airflow above the substrate 300 that is obstructed or impeded by the card edge modules 304. For example, the card edge modules 304 in the illustrated embodiment are loaded into the connector assembly 100 in such a manner that no part of the card edge modules 304 extend above the substrate 300 in the transverse direction 136. Instead, the connector assembly 100 receives the card edge modules 304 so the card edge modules 304 extend away from the substrate 300 and the edge 318 in a direction opposite of the rearward direction 130 and approximately parallel to the substrate 300. As the card edge modules 304 do not extend over the substrate 300 in the transverse direction 136 in the illustrated embodiment, more air can flow above the substrate 300 to cool or dissipate heat from other electronic components (not shown) mounted to the substrate 300 when compared to card edge modules (not shown) that are mounted to the connector assembly 100 so as to obstruct air flow above the substrate 300. Additionally, mating the card edge modules 304 with the connector assembly 100 in the manner illustrated permits air to flow in the rearward direction 130 between planes defined by the card edge modules 304.

Figure 4:
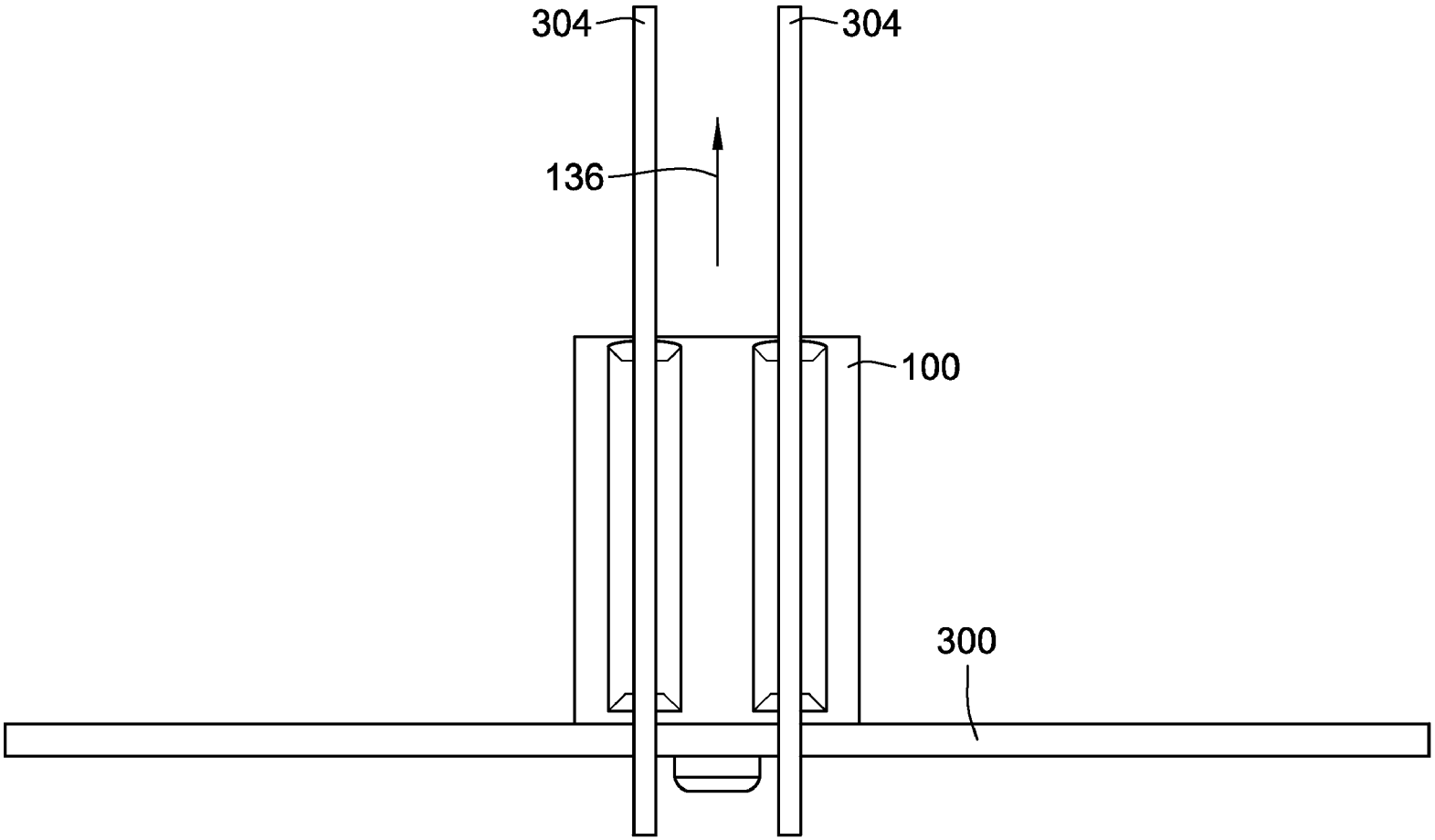
FIG. 4 is an elevational view of the connector assembly shown in FIG. 1 mounted to the substrate shown in FIG. 3 and mated with the card edge modules also shown in FIG. 3 in accordance with one embodiment.

FIG. 4 is an elevational view of the connector assembly 100 mounted to the substrate 300 and mated with the card edge modules 304 in accordance with one embodiment. As shown in FIG. 4, the connector assembly 100 mates with the card edge modules 304 to hold the card edge modules 304 in an orthogonal relationship with respect to the substrate 300 in one embodiment. The card edge modules 304 are held in an approximately parallel relationship with one another. As described above and illustrated in FIGS. 2 and 3, the mating contact tips 212 of the connector assembly 100 and the contact pads 312 of the card edge module 304 are linearly aligned in the transverse direction 136 with both the card edge modules 304 and the transverse direction 136 being approximately perpendicular to the substrate 300. Additionally, the connector assembly 100 may hold the card edge modules 304 such that the card edge modules 304 do not extend over or above the substrate 300. For example, the card edge modules 304 are not positioned over the substrate 300 and thus impede or obstruct the flow of air over the substrate 300 less than if the card edge modules 304 were positioned over the substrate 300.

It is to be understood that the above description is intended to be illustrative, and not restrictive. For example, the above-described embodiments (and/or aspects thereof may be used in combination with each other. In addition, many modifications may be made to adapt a particular situation or material to the teachings of the invention without departing from its scope. Dimensions types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a connector having a housing including a mounting face and a mating face disposed perpendicular to each other, the mounting face for mounting the connector to a substrate, the mating face having an elongated slot configured to receive a mating edge of a card edge module; and contacts extending between opposite contact tips at each of the mounting face and the mating face, the contact tips at the mounting face configured to electrically couple the connector with the substrate, the contact tips at the mating face arranged in rows on opposite sides of the slot with the contact tips in each row linearly aligned with each other in a direction that is perpendicular to the substrate, the contact tips configured to electrically couple the connector with the card edge module, wherein the card edge module is oriented perpendicular to the substrate when the card edge module mates with the connector.

2. The connector assembly of claim 1, wherein the connector comprises an elongated card edge slot at the mating face, the card edge slot elongated in a direction that is perpendicular to the substrate.

3. The connector assembly of claim 1, wherein the connector receives the card edge module proximate to an edge of the substrate such that the card edge module extends from the connector and away from the edge of the substrate in a direction that is perpendicular to the edge of the substrate.

4. The connector assembly of claim 1, wherein the rows of the contact tips at the mating face are aligned in directions perpendicular to the substrate such that each of the contact tips in each row is located a different distance from the substrate than the other contact tips in the same row.

5. The connector assembly of claim 1, wherein the connector includes a shroud and first and second contact module assemblies, the shroud including the mating face and the elongated slot, the first and second contact module assemblies abutting each other and at least partially disposed in the shroud, each of the first and second contact module assemblies including a subset of the contacts disposed in the slot.

6. The connector assembly of claim 5, wherein each of the first and second contact module assemblies includes an approximately planar body oriented perpendicular to the substrate.

7. The connector assembly of claim 5, wherein the first and second contact module assemblies comprise mating edges and mounting edges, the mating edges disposed at the mating face of the connector, the mounting edges disposed at the mounting face of the connector.

8. The connector assembly of claim 7, wherein the contacts extend from the mounting edges to the mating edges of the contact module assemblies.

9. The connector assembly of claim 5, wherein the contact tips of each of the first and second contact module assemblies have arcuate shapes.

10. The connector assembly of claim 9, wherein the contact tips of the first contact module assembly and the contact tips of the second contact module assembly are arched toward one another at the mating face of the shroud such that the contact tips are deflected away from one another when the card edge module is loaded into the slot between the contact tips.

11. The connector assembly of claim 5, wherein the elongated slot in the mating face of the shroud is a first slot, further comprising third and fourth contact module assemblies and the shroud including a second elongated slot, the third and fourth contact module assemblies abutting each other and at least partially disposed in the shroud, each of the third and fourth contact module assemblies including a subset of the contacts disposed in the second slot.

12. The connector assembly of claim 11, wherein the shroud includes a support element protruding in a rearward direction away from the mating face and between the first and second slots, the support element separating the first and second contact module assemblies from the third and fourth contact module assemblies.

13. A connector assembly for mating a card edge module with a substrate, the connector assembly comprising:

a connector having perpendicular mounting and mating faces, the mounting face for mounting the connector to the substrate, the mating face for receiving the card edge module to mechanically couple the connector and card edge module;

first and second contact module assemblies disposed in the connector and oriented perpendicular to the substrate, the first and second contact module assemblies each comprising a mounting edge disposed proximate the mounting face and a mating edge disposed proximate the mating face; and contacts disposed in the contact module assemblies and extending from the mounting edges to the mating edges, the contacts engageable with the substrate and the card edge module to electrically couple the substrate and the card edge module, wherein the contacts comprise mating tips projecting from the mating edges of the first and second contact module assemblies, the mating tips arranged in opposing rows oriented in directions that are perpendicular to the substrate.

14. The connector assembly of claim 13, wherein the mounting and mating edges of the first and second contact module assemblies are disposed perpendicular to one another.

15. The connector assembly of claim 13, wherein the mating face of the connector includes a card edge slot shaped to receive the card edge module, the card edge slot oriented perpendicular to the substrate.

16. The connector assembly of claim 13, wherein the card edge module is received between the opposing rows of the mating tips.

17. The connector assembly of claim 13, wherein the connector receives the card edge module proximate to an edge of the substrate such that the card edge module extends away from the connector and the edge of the substrate in a direction perpendicular to the edge of the substrate and parallel to the substrate.

18. The connector assembly of claim 13, wherein the first and second contact module assemblies comprise approximately planar dielectric bodies oriented perpendicular to the substrate.

19. The connector assembly of claim 18, wherein the planar dielectric bodies are oriented parallel to the card edge module when the card edge module engages the connector.

20. The connector assembly of claim 13, wherein the connector comprises a dielectric shroud at the mating face, the mating edges of the first and second contact module assemblies disposed within the dielectric shroud.

21. The connector assembly of claim 13, wherein the rows of the mating tips of the contacts at the mating edges are aligned in directions perpendicular to the substrate such that each of the mating tips in each row is located a different distance from the substrate than the other mating tips in the same row.

22. The connector assembly of claim 13, wherein the connector includes first and second slots that are elongated perpendicular to the substrate, the first and second contact module assemblies holding a first subset of the contacts within the first slot, and further comprising third and fourth contact module assemblies holding a second subset of the contacts within the second slot.

23. The connector assembly of claim 22, wherein the connector includes a support element protruding in a rearward direction away from the mating face and between the first and second slots, the support element separating the first and second contact module assemblies from the third and fourth contact module assemblies.

* * * * *